US005681226A

United States Patent [19]

Chambers, Jr.

[11] Patent Number: 5,681,226

[45] Date of Patent: Oct. 28, 1997

[54] GOLF CLUB SHAFT WITH OVERSIZED GRIP SECTION

[75] Inventor: Marshall H. Chambers, Jr., Nantucket, Mass.

[73] Assignee: Marshall James, Inc., Siasconset, Mass.

[21] Appl. No.: 656,708

[22] Filed: Jun. 3, 1996

[51] Int. Cl.[6] ..... A63B 53/14; A63B 53/12

[52] U.S. Cl. ..... 473/300; 473/316

[58] Field of Search ..... 473/201, 202, 473/203, 204, 206, 300, 301, 302, 303, 288, 289, 313, 314, 251, 219, 226, 316, 318, 323

[56] References Cited

U.S. PATENT DOCUMENTS

| | | | |
|---|---|---|---|
| 1,167,106 | 1/1916 | Palmer . | |
| 2,050,554 | 8/1936 | Barnhart | 473/323 |
| 3,614,101 | 10/1971 | Hunter | 473/301 |
| 3,837,647 | 9/1974 | Jacques . | |
| 4,186,924 | 2/1980 | Southey . | |
| 4,215,860 | 8/1980 | Nakamatsu | 473/201 |
| 4,272,077 | 6/1981 | Spivey | 473/300 |
| 4,330,126 | 5/1982 | Rumble | 473/323 |
| 4,746,120 | 5/1988 | Mockovak | 473/301 |
| 5,265,872 | 11/1993 | Tennent et al. . | |
| 5,547,189 | 8/1996 | Billings | 473/305 |

*Primary Examiner*—Sebastiano Passaniti

*Attorney, Agent, or Firm*—Brown, Martin, Haller & McClain

[57] ABSTRACT

A golf club shaft is described which has an upper grip portion with significantly greater diameter than the largest diameter of the lower power portion, with the two portions joined by an S-shaped transition portion. The large diameter of the grip portion permits recreational players or players with relatively weak hands to exert more power and greater control of the fine movements of the club shaft and golf club. The grip section has a minimum diameter at least 35% greater than the maximum diameter of the power section and the transition section has a length not greater than 15% of the overall length of the shaft. The shaft may be made of any convenient material which can be formed into the curves of the transition section without imposing undue stresses in the curved portions. The shaft may be formed of metal or, preferably, a fiber/polymer composite material. The shaft permits the typical recreational player to improve his or her game by being able to obtain significantly better control of the alignment of club face and ball during the swing and shot, without requiring any increase in the player's normal hand and wrist gripping strength. It is also of utility for players who have arthritis or other debilitating conditions in their hands and wrists, in that it permits them to play better with their limited gripping ability, and in some cases permits resumption of limited play where to play at all had become unacceptably difficult because of the physical problems.

10 Claims, 1 Drawing Sheet

GOLF CLUB SHAFT WITH OVERSIZED GRIP SECTION

BACKGROUND OF THE INVENTION

1. Field of the Invention

The invention herein relates to golf club shafts. More particularly it relates to shafts with non-uniform configurations.

2. Description of the Prior Art

In order to play golf successfully, the player must be able to control the golf club shaft and club head during the swing. If the club face does not strike the ball squarely and facing toward the target area into which the player intends to place the ball, the flight of the struck ball will follow a path curving away from the intended flight path. Most recreational players, while they do not have any particular physical problems with grasping and holding a conventional golf club in an average manner, do not have a sufficient level of skill or coordination to strike the ball squarely on a consistent basis. The ordinary golfer therefore commonly finds himself or herself hitting many hooks and slices during the course of a round of golf. Not only does this raise the player's score, but it also contributes to the player's sense of frustration with the game.

Most recreational golfers have neither the time nor the ability to hone their skills to the point where they can consistently hit the ball squarely. Consequently, they feel themselves doomed to continue to hit bad shots no matter how much they wish to improve their game. These golfers represent a large segment of the golf market, and may in fact constitute the majority of golfers. It would therefore be of significant benefit if a golf club shaft structure were available which would allow the typical recreational golfer to maintain better control of a golf club during the swing, to produce more consistent and accurate alignment of the club face with the ball, and would do so using only normal strength and coordination of the typical golfer.

In addition, for one limited group of golfers, the problems with conventional clubs are even worse. These are players who have arthritis or other debilitating conditions in their hands and wrists, and therefore have great difficulty exerting enough force to grasp a club firmly, even for a limited time. In fact, in the more severe cases, the "arthritic" person cannot close his or her hand sufficiently to grasp a conventional club at all.

There have been efforts made in the past by golf club manufacturers to accommodate grasp and control problems for both regular recreational golfers and the arthritic golfer. Such efforts have normally been in either of two directions. First, it has been very common for manufacturers to fit the conventional shafts with "oversize"(i.e., extra thick) hand grips. Several lines of clubs with such oversize grips are currently available commercially in the marketplace. Such grips, however, are not particularly satisfactory. The fatter grips often work to the extent that players with arthritis are better able to grasp the club. However, because the grips are made of pliable materials such as rubber, players are still unable to control the twisting or torque of the club shaft, so that they are unable to produce consistent alignments of club face and ball over the course of a round of golf.

The other approach to the problem has been to fit conventional club shafts with specially configured grips. Unlike conventional cylindrical grips, these shaped grips are normally molded so as to create ridges, protrusions, hollows and the like in the grip's surface, into and around which the player can fit his or her hands. An example is illustrated in U.S. Pat. No. 4,186,924 (to Southey). Designers of such shaped grips contend that the ridges, etc. allow the player grasp the club with significantly more force and control than would be possible with the ordinary smooth cylindrical grip. However, such types of grips have not found particular favor with players, nor have they effectively dealt with the problem. Unless such grips are custom-made to a player's unique hand configuration, the location of the various ridges, etc. must be arbitrarily chosen by the designer (as they are in the Southey grip) and therefore cannot be equally effective for all players. Further, as with the oversize grips, there is a significant degree of added thickness in the raised portions of these shaped grips, so that the problem of excess resiliency remains.

Club shafts of varying diameters and incorporating changes or "steps" in the shaft diameter have been known for many years. A typical early example is illustrated in U.S. Pat. No. 1,167,160 (to palmer). Many variations on the same theme have been disclosed in patents and golf literature. To the best of this inventor's knowledge, however, all such shafts have located such steps, grooves and other structural variations along the length of the shaft well below the grip, extending down to the lower end of the shaft where it is secured in the club head hosel. The steps have been used to provide varying degrees of stiffness or controlled distortion of the "power portion" of the club shaft well below the grip, with the intent that such changes in shaft structure will enhance club control or allow the club head to impart greater impact force and speed to the struck ball. In all of these cases, however, the upper or grip end of the shaft has not been subject to significant reconfiguration. Rather the grip section has been maintained as merely an extension of the upper end of the power portion of the shaft. In other words, in the prior art shaft structures the upper or grip portion has been used simply as the location where the player places his or her hands to grasp the club, but there has been little consideration of the grip portion as having a significant effect on the playing properties of the club.

Thus, many recreational golfers find that they are unable to consistently improve their game beyond a certain point because they have reached the maximum of their ability to consistently exert control over the alignment of the golf club shaft and club face. Similarly, arthritic golfers find that while their ability to grip some clubs may be improved, they still retain little ability to control the club effectively, and therefore to play golf in a consistent and satisfying manner.

SUMMARY OF THE INVENTION

The invention herein provides a unique structure of a golf club shaft, which provides recreational golfers with greatly enhanced ability to control the alignment of a club and maintain consistency in their shots. Since golf is a game in which very small incremental changes in the angle of a club face at the point of striking the ball can make major differences in a player's score in a game, such ability to exert much better fine control is a definite improvement over prior art golf club shafts. By providing a shaft design and structure which can be grasped firmly by an average golfer for consistent control over the course of a round of golf, the golfer's playing ability is enhanced and the game becomes less frustrating and more enjoyable.

Similarly, the present invention provides significant improvement for the play of golfers with arthritic or similar conditions in their hands and wrists. The shafts of the present invention are intended to be used with conventional relatively thin grips, so that the arthritic golfer can not only grasp the club satisfactorily, but can also assert a greater measure of control because the relatively thin grip is not so thick and resilient that unwanted movement occurs.

The benefits of the present invention are obtained by providing a golf club shaft with a structural configuration such that the upper or grip portion (butt) of the shaft is of significantly greater diameter than the largest diameter of the lower or power portion of the shaft. This permits the use of a conventional thin grip attached to the outer surface of the grip section of the shaft of this invention, so that there is ample gripping surface for the player's hand to comfortably grasp the club. However, the shaft of this invention on which the grip is mounted has such a large diameter that it inherently provides more angular control over the club face. For a straight shot, the optimum position of the club face is precisely perpendicular to the flight line of the ball. The large diameter butt provides the golfer with a larger margin of error. For example, a change of ¼" (6 mm) in the perimeter of the butt of the present invention results in a lesser deviation at the club face than the same ¼" (6 mm) change in the perimeter of a conventional sized shaft. (One finds an analogous comparison of ability to exert fine control when considering the difference between tuning a radio or television set with large diameter knobs as compared to attempting to tune using small diameter knobs.)

When gripping a conventional shaft the golfer is essentially making fists with his hands. With the hands in this position the muscles of the forearms are tightened and restrict the golfer's range of motion. The larger diameter butt of the invention allows the golfer to use a non-interlocking grip. The increased surface area of the shaft of this invention, by design, comes into contact with a larger portion of the player's hands and fingers. This affords greater comfort and control and facilitates a more natural "baseball style" grip. When using the "baseball style" grip with the present invention, it is natural for the golfer to increase the back swing by 20%–30% both comfortably and with control. When the hands are in this comparably open position, the muscles of the forearms are more relaxed, thereby increasing the golfer's range of motion. These same muscles can then be used to generate swing or club head speed.

In the present shaft, the grip section and the power section are joined by an axially short transition section, which essentially incorporates an S-curve into the profile of the club shaft to provide a smooth transition between the smaller maximum diameter of the power portion of the shaft and the larger minimum diameter of the grip section of the shaft. In a particularly preferred configuration, the shaft of the present invention will have a straight tapered power portion and a straight cylindrical grip portion. With a straight cylindrical grip portion, the player's hands and fingers will lie evenly on the grip, thus avoiding problems associated with trying to grasp a grip having a range of diameters.

Therefore, in a broad embodiment, the present invention is described as a golf club shaft comprising a lower club head end, an upper grip end, a lower power section and an upper grip section, the sections joined by a transition section, the upper grip section having a minimum diameter at least 35% greater than the maximum diameter of the lower power section and the transition section having a length not greater than 15% of the overall length of the shaft. Preferably the length of the lower power section is at least 2.5 times greater than the length of the upper grip section.

DETAILED DESCRIPTION AND PREFERRED EMBODIMENTS

Figure 1:
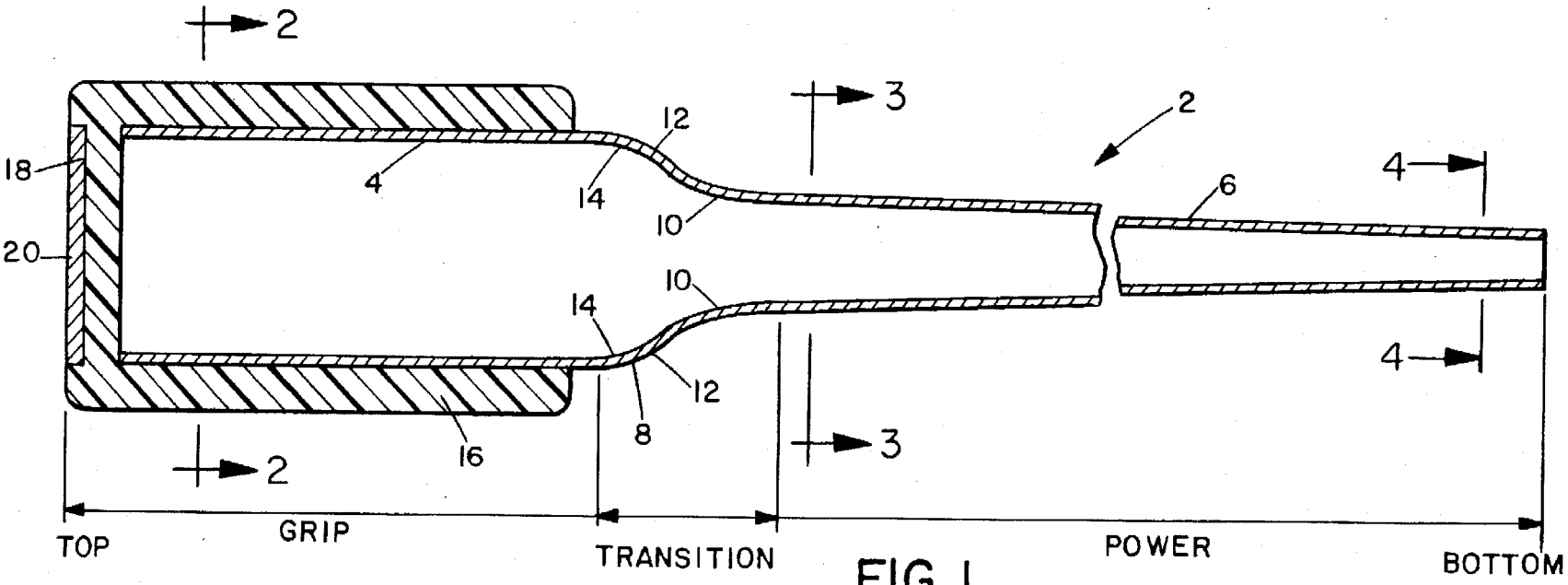
FIG 1 is a side elevation cross-sectional view of a shaft of the present invention taken axially along the centerline of the shaft.

The present invention is best understood by reference to the drawings, and in particular to FIG. 1. A club shaft of the present invention, generally designated 2, is constructed with three sections. The grip section (butt) 4 is at the upper end of the shaft and the lower end of the shaft is the power section 6. A transition section 8 joins the two. (For clarity of illustration, the power section 6 is shown at less than its full relative length. It will be understood that the taper illustrated extends uniformly through the broken out portion.) The material from which the shaft may be made, preferably a fiber/polymer composite, will be described below.

The power section 6 of the shaft 2 is the longest single portion and commonly is on the order of 30–36 in. (760–910 mm) in length. In diameter, the lower (hosel) end normally has the minimum diameter, usually about ⅜ in. (10 mm), and the shaft tapers upwardly expanding to approximately ⅝ in. (16 mm) at the upper end of the power portion where it meets the transition section 8. The wall thickness of the power portion 6 will normally be uniform throughout its length. The actual wall thickness will depend upon the type of material from which the shaft is made, with composite materials commonly requiring greater thickness than metal.

The upper or grip section 4 of the shaft is normally formed as a right circular cylinder of a diameter in the range of 1⅛.–1⅜ in. (29–35 mm). In this portion also, the wall thickness is normally uniform throughout the section. Depending on the method of manufacture, the wall thickness in the grip portion may be different from or the same as the wall thickness in the power portion. The grip section will normally be approximately 9–12 in. (230–310 mm.) in length.

Figure 5:
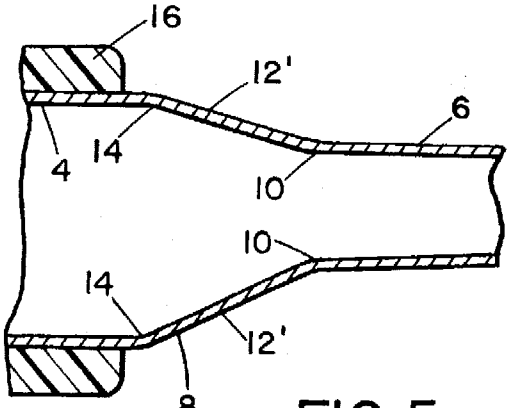
FIG. 5 is a side elevation cross-sectional view of a portion of a shaft of this invention, illustrating in isolation another embodiment of the transition section of the shaft.

Joining the two sections 4 and 6 is the transition section 8. Transition section 8 has a generally funnel-like or S-shape expanding from the smaller diameter of the power section 6 at its junction with that section to the larger diameter of the grip section 4 at its junction with that section. It is undesirable to have abrupt step changes in a shaft, since forces will concentrate at such steps and provide zones of weakness which are prone to buckle from the transmitted impact with a golf ball. Therefore the transition section 8 has a generally S-shaped axially cross-section in its walls, as evident from FIG. 1. In the embodiment shown in FIG. 1, the transition section 8 has a transition curve 10 from the junction with the power section 6 at the lower end to a junction 12 with a second transition curve 14 in the opposite direction leading to a junction with the grip section 4. In another embodiments, shown in FIG. 5, the two opposite transition curves 10 and 14 are substantially shortened, such that the junction 12 becomes a straight tapered section 12'. The curves 10 and 14 and the bridging section 12' or junction 12 can be varied in length and curvature as desired.

The transition section will normally have an axial length of not more than about 15of the overall length of the shaft 2, and more preferably will be less, down to as little as about 4–5% of the shaft length. It will be evident that the proportions will change depending on the overall length of the shaft and the degree of curvature of the curved sections 10 and 14 and the length of the resultant intermediate portion 12/12'. The smaller the radius of curvature of each curve and the shorter the portion 12/12', the shorter will be the axial length of the transition section 8. In a preferred embodiment, each curve 10 and 14 has a radius of 9"(229 mm) and the curves' radii transition smoothly into each other, such that 12 represents a line junction without significant axial length.

Figure 3:
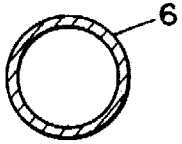
FIGS. 2, 3 and 4 are radial cross-sectional views of the shaft of FIG. 1 taken respectively on lines 2—2, 3—3 and 4—4.
Figure 4:
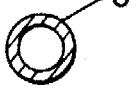
Figure 2:
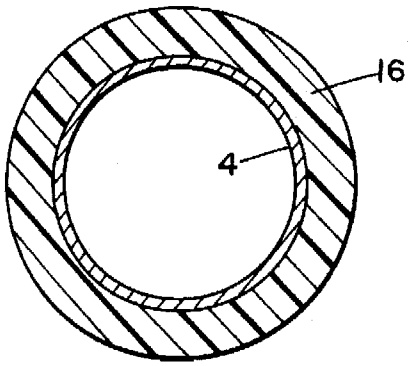

Attached to the outside surface of the grip section 4 is a hand grip 16. This hand grip 16 may be in the form of a hollow cylinder closed at one end as shown in FIG. 1, such that the grip can simply be slid over the upper end of the grip section 4 and will close off the open end of the shaft. A recess 18 may be left in the end of the grip 16 so that a disc or medallion 20 can be placed in the recess either for decorative purposes or for identification (for instance, the medallion could be imprinted with the manufacturer's logo or with the player's initials). Alternatively, the grip 16 may be an open hollow cylinder, in which case a separate plug, essentially a deeper embodiment of the medallion 20, is then placed over the open end of the club to close the shaft. Normally such plugs are somewhat mushroom-shaped, with an outer radius equal to that of the grip 16, so that the completed grip and plug present a sealed and finished appearance. Unlike the "oversized" grips of the prior art, the grip 16 has a conventional thickness. Impressed ribs, ridges, depressions or the like in its surface are not needed, although such may be used sparingly without significantly changing the play of the club. FIGS. 2, 3 and 4 illustrate the radial cross-sectional shapes of the shaft at respectively the grip section 4 and the upper and lower ends of the power section 6. The Figures are not intended to show exact scale, but rather to illustrate the relative structures in which the diameter of the grip section 4 is significantly greater than the maximum diameter of the power section 6.

The club shaft 2 may be made of any convenient material which can be formed into the curves of the transition section 8 without imposing undue stresses in the curved portions. The shaft may be formed of metal such as steel, titanium or aluminum using conventional metal tube forming techniques such as drawing or expansion molding. More preferably, however, the shaft will be made out of a fiber/polymer composite material. Such materials are well known in the golf shaft industry and comprise a polymeric matrix through which is distributed a fibrous reinforcing material.

The preferred fibers for reinforcement are carbon, glass, aramid and extended chain polyethylene fibers, most preferably the carbon fibers. (As used herein, the term "carbon fibers" encompasses all carbon-based fibers, including "graphite fibers.") Reinforcement fibers are available commercially from a variety of sources and under numerous different trade names, including "Kevlar"™ for aramid fibers and "Spectra"™ for extended chain polyethylene fibers. These fibers, and their use as resin reinforcements, are widely described in the literature; one comprehensive source is Rubin (ed.), *Handbook of plastic Materials and Technology*, chapters 70–77 (Wiley Interscience: 1990). Other sources include, for carbon fibers, Matlick, *Fiber-Reinforced Composites: Materials, Manufacturing, and Design* (Marcel Decker, N.Y.: 1988); Gill, *Carbon Fibres in Composite Materials* (Iliffe Books, London: 1972) and Watt et al., *Handbook of Composites—Volume* 1: *Strong Fibres* (Elsevier Science publ., N.Y.: 1985), and for other fibers, including glass and aramid, *Modern plastics Encyclopedia* 88, 64 (10A), 183–190 (1987). Typical of the resins which may be used are thermosetting resins or polymers such as the phenolics, polyesters, melamines, epoxies, polyimides, polyurethanes and silicones; the properties and methods of manufacture of these polymers are also described in the previously mentioned *Handbook of plastic Materials and Technology and Modern plastics Encyclopedia* 88.

Composite shafts are formed by wrapping numerous thin sheets of the composite material around a mandrel until the desired shaft wall thickness is built up. Commonly adjacent layers of sheets will be aligned at different angles, so that the reinforcing fibers have different orientations. The formed shaft is then heated to cause the polymeric matrix to set and harden. If desired, one can also include additional wraps or coatings to the shaft's outer surface to impart colors, design patterns or the like to the shaft in any one or more of the sections, and produce attractive colored, logoed or patterned club shafts. Recently such colored and patterned shafts have become quite popular, particularly outside the United States. It is also possible to add a textured coating material to one or more areas of the shaft, although it is preferred to retain a smooth untextured surface. Typically the shaft is finished by having applied a "clear coat" finish, such as a clear polyurethane, for maximum durability and resistance to weather and sun. Shafts are normally subject to typical quality control tests to confirm the flex, torque and stiffness characteristics, as well as to measure any other properties which the manufacturer or vendor believes to be significant. Finally, it is common to coat the shafts with a peelable protective coating, such as a clear plastic film, to protect the shafts during shipping to the club manufacturers.

After completion of manufacture, the shafts are used to form finished golf clubs, either by the shaft manufacturer or by a separate club manufacturer to whom the shaft manufacturer sells the shafts. The grip 16 can be attached in the conventional manner using a layer of adhesive (not shown) between the outer surface of the grip section 4 and the inner surface of the grip 16. The lower end of the shaft is seated in the hosel of an iron or wood club head (not shown), and then secured within the hosel with any of various types of adhesive to form an iron club or a wood club. An example of securing a club head hosel to a shaft is illustrated in U.S. Pat. No. 5,265,872 (to Tennent et al).

The clubs made with the shaft of the present invention are significantly easier for players with restricted hand grasping ability to use, and also are found to permit recreational golfers to play with better control and more power in their swing. The more open grip configuration which one uses with a club made with the shaft of the present invention can permit a golfer to comfortably increase his or her back swing by 20–30%, since the muscles of the forearms are not tightened as much as occurs with the more closed hand configurations required by conventional clubs. Thus, use of the large diameter grip shaft of the present invention permits one to grasp a club readily but without the loss of control that occurs because of the increased resiliency and vibration inherent in a prior art oversized grip.

It will therefore be recognized that the structure defined above permits the player to grasp the shaft and grip in a normal manner as one would do with a conventional club shaft, with the normal amount of gripping force of which the individual player is capable. However, in the present invention, because the grip portion of the shaft itself is of significantly greater diameter than the grip portions of conventional shafts, the player's hands can exert a much more controlled grasp of the club with that same amount of gripping force. The ordinary recreational golfer can therefore play a more controlled game, thus presumably lowering his or her average score. The player will thereby suffer less frustration at poor play caused by physical limitations, and thus realize the enjoyment which he or she had expected upon taking up the game.

Similarly, for the player with hand, wrist or arm infirmities such as arthritis, the invention provides the opportunity to play the game with significantly reduced limitations, or, for many, to once again play golf at all.

It will be evident from the above that there are numerous embodiments of the present invention which, while not expressly described above, are clearly within the scope and spirit of the present invention. The above description is therefore intended to be exemplary only and the invention is to be limited solely by the appended claims.

I claim:

1. A golf club shaft which permits a golfer to exert enhanced control of a golf club which incorporates said shaft, said shaft comprising a lower club head end, an upper grip end, a lower power section and an upper grip section, said sections joined by a transition section, said upper grip section having a minimum diameter at least 35% greater than the maximum diameter of said lower power section and said transition section having a length not greater than 15% of the overall length of said shaft, wherein the change in diameter between the minimum of said upper grip section and the maximum diameter of said lower power section occurs along said transition section.

2. A golf club shaft as in claim 1 wherein said minimum diameter of said upper grip section is at least 40% greater than said maximum diameter of said lower power section.

3. A golf club shaft as in claim 1 wherein said upper grip section has a uniform diameter throughout substantially all of its length and said lower power section is tapered from a maximum diameter proximate to said transition section to a minimum diameter at said lower club head end.

4. A golf club shaft as in claim 3 wherein the taper of said lower power section comprises a straight taper throughout the length of said section.

5. A golf club shaft as in claim 1 wherein said transition section has an S-shaped axial cross-section.

6. A golf club shaft as in claim 5 wherein said S-shaped cross-section comprises two oppositely curved segments joined at their respective abutting ends.

7. A golf club shaft as in claim 5 wherein said S-shaped cross-section comprises two oppositely curved segments joined by a straight segment.

8. A golf club shaft as in claim 1 further comprising a grip co-axial with said upper grip section and attached to and extending over a substantial portion of an outer surface of said upper grip section.

9. A golf club shaft as in claim 1 wherein the length of said lower power section is at least 2.5 times greater than the length of said upper grip section.

10. A golf club shaft as in claim 9 wherein the length of said lower power section is at least three times greater than the length of said upper grip section.

* * * * *

UNITED STATES PATENT AND TRADEMARK OFFICE

CERTIFICATE OF CORRECTION

PATENT NO. : 5,681,226
DATED : October 28, 1997
INVENTOR(S) : MARSHALL H. CHAMBERS, JR.

It is certified that error appears in the above-indentified patent and that said Letters Patent is hereby corrected as shown below:

COLUMN 7, CLAIM 1, LINE 21,AFTER "MINIMUM" INSERT

--DIAMETER--.

Signed and Sealed this

Twenty-fourth Day of February, 1998

*Attest:*

*Attesting Officer*

BRUCE LEHMAN

*Commissioner of Patents and Trademarks*